US007090914B2

(12) United States Patent
Yamagata et al.

(10) Patent No.: US 7,090,914 B2
(45) Date of Patent: Aug. 15, 2006

(54) COATED CUTTING TOOL

(75) Inventors: Kazuo Yamagata, Itami (JP); Akihiko Ikegaya, Itami (JP)

(73) Assignee: Sumitomo Electric Industries, Ltd., Osaka (JP)

( * ) Notice: Subject to any disclaimer, the term of this patent is extended or adjusted under 35 U.S.C. 154(b) by 0 days.

(21) Appl. No.: 11/138,258

(22) Filed: May 27, 2005

(65) Prior Publication Data

US 2005/0220546 A1 Oct. 6, 2005

Related U.S. Application Data

(63) Continuation of application No. 10/069,965, filed as application No. PCT/JP01/06000 on Jul. 11, 2001, now abandoned.

(30) Foreign Application Priority Data

Jul. 12, 2000 (JP) ..... 2000-211832

(51) Int. Cl.
*B32B 9/00* (2006.01)

(52) U.S. Cl. ..... 428/216; 51/307; 51/309; 428/336; 428/174; 428/698; 428/701

(58) Field of Classification Search ..... 51/307, 51/309; 428/174, 216, 336, 698, 701
See application file for complete search history.

(56) References Cited

U.S. PATENT DOCUMENTS

| | | | |
|---|---|---|---|
| 4,470,895 | A | 9/1984 | Coad |
| 4,643,620 | A | 2/1987 | Fujii et al. |
| 4,966,501 | A | 10/1990 | Nomura et al. |
| 5,431,072 | A | 7/1995 | Christoffel |
| 5,597,272 | A | 1/1997 | Moriguchi et al. |
| 5,643,658 | A | 7/1997 | Uchino et al. |
| 5,771,763 | A | 6/1998 | Naslund et al. |
| 5,861,210 | A | 1/1999 | Lenander et al. |
| 5,920,760 | A | 7/1999 | Yoshimura et al. |
| 5,945,207 | A | 8/1999 | Kutscher et al. |
| 6,071,601 | A | 6/2000 | Oshika et al. |
| 6,082,936 | A | 7/2000 | Moriguchi et al. |
| 6,093,479 | A | 7/2000 | Yoshimura et al. |
| 6,333,098 | B1 | 12/2001 | Olsson et al. |

FOREIGN PATENT DOCUMENTS

| | | |
|---|---|---|
| EP | 298729 | 1/1989 |
| EP | 0685572 | 12/1995 |
| EP | 878563 | 11/1998 |
| JP | 01016302 | 1/1989 |
| JP | 2105396 | 1/1989 |
| JP | 05057507 | 3/1993 |

(Continued)

OTHER PUBLICATIONS

English Language Abstract of JP 5-57507.

(Continued)

*Primary Examiner*—Archene Turner
(74) *Attorney, Agent, or Firm*—Greenblum & Bernstein, P.L.C.

(57) ABSTRACT

A coated cutting tool with a hard coating layer formed on a substrate. The substrate comprises a binder phase and a hard phase. The coating layer comprises a smooth face having a surface roughness of 0.2 μm or less substantially at the blade-edge ridge and in a region which extends at least 200 μm from the rake face side boundary of the ridge toward the rake face side, and extends at least 50 μm from the flank side boundary of the ridge toward the flank side.

20 Claims, 1 Drawing Sheet

FOREIGN PATENT DOCUMENTS

| | | |
|---|---|---|
| JP | 08-150502 | 6/1996 |
| JP | 10138034 | 5/1998 |

OTHER PUBLICATIONS

English Language Translation Abstract of JP 10-138034.
English Language Translation Abstract of JP 10-16302.
English Language Translation Abstract of JP 7-73802.
Partial English Translation of JP 5-57507, published Mar. 9, 1993.
Machine Translation of JP 5-57507, published Mar. 9, 1993.
English Language Translation Abstract of JP 8-150502, published Jun. 11, 1996.
Machine Translation of JP 8-150502, published Jun. 11, 1996.

COATED CUTTING TOOL

CROSS-REFERENCE TO RELATED APPLICATIONS

The present application is a continuation of U.S. application Ser. No. 10/069,965, the entire disclosure whereof is expressly incorporated by reference herein, which is a National Stage of International Application No. PCT/JP01/06000, filed Jul. 11, 2001, now abandoned which claims priority under 35 U.S.C. § 119 of Japanese Patent Application No. 2000-211832, filed Jul. 12, 2000.

TECHNICAL FIELD

The present invention relates to a cutting tool in which a hard layer having excellent wear resistance is formed.

BACKGROUND ART

There have been attempts to improve fracture resistance and wear resistance of super hard alloy cutting tools and lengthen the life of tools by depositing a coating layer of titanium carbide, titanium nitride, titanium carbonitride, aluminum oxide, or the like on the surface of a WC-group sintered hard alloy or cermet substrate.

When cutting is carried out, particularly, when a workpiece which easily welds is cut by using these coated cutting tools, problems have frequently occurred in which the coating layer spalls away due to such welding and adhesion, and furthermore, fracturing of the substrate progresses, resulting in a decrease in the life of the tools.

In order to solve these problems, Japanese Patent Nos. 2105396 and 2825693 disclose a technique for suppressing welding and adhesion of a workpiece and enhancing wear resistance and toughness by improving surface roughness by mechanically grinding the surface of the coating layer at the blade-edge ridge of a cutting tool.

However, these techniques are insufficient to suppress the shortening of the tool life due to the progress of wear accompanying layer spalling at the rake face side and layer chipping at the flank side particularly in the case of cutting a workpiece of ductile cast iron, stainless steel, Inconel, or the like which easily welds and adheres.

Furthermore, since the surface roughness of a workpiece deteriorates, the desired roughness of the machined surface cannot be obtained in the case of finishing in which machining accuracy is required.

Recently, considering environmental problems, cutting without using a cutting oil (dry cutting) has become prevalent. However, in this case, due to loss of the lubricating effect of a cutting oil, welding and adhesion of a workpiece accelerates, and accordingly, decrease in the life and deterioration in roughness of machined surface have come into question.

Therefore, the main object of the invention is to provide a coated cutting tool in which fracture resistance and wear resistance are simultaneously realized, tool life is improved, and surface roughness of machined workpiece is improved.

DISCLOSURE OF THE INVENTION

The inventors examined the above-mentioned problems, and found that the problems can be solved when a hard coating layer is formed such that it has smooth surfaces at the blade-edge ridge, a range of at least 200 μm from the rake face side boundary of the blade-edge ridge toward the rake face side, and a range of at least 50 μm from the flank side boundary of the blade-edge ridge toward the flank side.

That is, a coated cutting tool according to the invention is a coated cutting tool with a hard coating layer applied on the substrate, wherein the substrate comprises a binder phase comprising one or more kinds of iron-group metals and a hard phase comprising one or more kinds of substances selected from the group consisting of carbides, nitrides, and oxides of the periodic table IVa-, Va-, and VIa-group elements, and solid solutions thereof. The hard coating layer comprises a smooth face having a surface roughness (Rmax) of 0.2 μm or less (the reference length: 5 μm) substantially at the blade-edge ridge, a range of at least 200 μm from the rake face side boundary of the blade-edge ridge toward the rake face side, and a range of at least 50 μm from the flank side boundary of the blade-edge ridge toward the flank side.

When cutting a workpiece of ductile cast iron, stainless steel, Inconel, or the like, which easily welds and adheres, in a range of 200 μm from the rake face side boundary of the blade-edge ridge toward the rake face side, chips weld and adhere to the coating layer, and when the adhered matter comes off, the coating layer also spalls, resulting in damage to the substrate. Also in a range of at least 50 μm from the flank side boundary of the same blade-edge ridge toward the flank side, chips weld and adhere due to micro-chipping of the coating layer and abnormal wearing progresses, or the surface unevenness of the coating layer and adhered matter on the surface are transferred onto the workpiece, resulting in deterioration in surface roughness of the machined workpiece.

Therefore, the hard coating layer at the blade-edge ridge, a range of at least 200 μm from the rake face side boundary of the same blade-edge ridge toward the rake face side, and a range of at least 50 μm from the flank side boundary of the same blade-edge ridge toward the flank side is formed to be substantially 0.2 μm or less in surface roughness (Rmax) (the reference length is set to 5 μm), whereby such welding and adhesion of a workpiece and such transferring onto the workpiece are prevented. Thus, the tool life can be improved by increasing fracture resistance and wear resistance simultaneously, and the surface roughness of a machined workpiece can also be improved. Particularly, this effect is more remarkable in the case of dry cutting. It is desirable that the hard coating layer comprises one or more kinds of substances selected from the group consisting of carbides, carbonitrides, borides, and oxides of one or more kinds of metal elements selected from the periodic table IVa, Va, and VIa groups, Al, and Si, and the solid solutions thereof.

The surface of the hard coating layer having a substantially smooth surface roughness means that the surface does not necessarily have predetermined surface roughness in the whole of the above-mentioned defined ranges, but in an area ratio of approximately 50% or more of the whole defined ranges.

If the invention is applied to a non-ground type tool in which the flank of the substrate has an as-sintered surface, the effect of the present invention is more remarkable. Recently, for reducing manufacturing costs, non-ground type tools have widely diffused, in which the tool flank side has an as-sintered surface. In this case, tool surface unevenness may be transferred onto a workpiece, or welding and adhesion occur, resulting in abnormal wear and deterioration in surface roughness of the workpiece. Application of the present invention to such case therefore produces more remarkable effects.

The range of the smooth surfaces is set to be a range in which crater friction and adhesion occur due to friction with chips in the section from the blade-edge ridge toward the rake face side. The range of at least 200 μm from the rake face side boundary of the blade-edge ridge toward the rake face side must always be a smooth formation, however, depending on the workpiece and cutting conditions, it is further desirable that a range of 500 μm from the rake face side boundary of the blade-edge ridge toward the rake face is a smooth formation.

At the flank side, the range for a smooth formation is set to a range in which chips due to micro-chipping of the coating layer may weld, adhere, and cause abnormal wear to progress, or surface unevenness or adhered matter on the surface of the coating layer may be transferred onto a workpiece and cause the surface roughness of the machined workpiece to deteriorate. A range of at least 50 μm from the flank side boundary of the blade-edge ridge toward the flank side must always be a smooth formation. It is more desirable that this range be expanded to a range of 200 μm from the flank side boundary of the blade-edge ridge toward the flank side.

The setting of a smooth surface roughness (Rmax) to 0.2 μm or less (the reference length is set to 5 μm) is required because desired effects cannot be obtained if the surface roughness exceeds 0.2 μm. It is more preferable that a surface roughness be smaller than this.

As a method for measuring the surface roughness, the section of the hard coating layer may be observed by means of a scanning electron microscope photograph. The bard phase particles of sintered hard alloys and cermet are generally in a range of 3–5 μm, and the particles project and form an undulation with a height of 2–3 μm and a width of 5–7 μm. Therefore, the reference length is set to 5 μm to specify the surface roughness, eliminating influences from such undulation.

The hard coating layer may be a single layer or a lamination layer. In the case of a lamination layer, it is desirable that the layer comprises an inner layer comprising at least one or more layers of Ti (CwBxNyOz) (herein, $w+x+y+z=1$, $w,x,y,z \geqq 0$), a middle layer composed of an aluminum oxide layer, and an outer layer made from $TiCxNyO_{1-x-y}$ or $ZrCxNyO_{1-x-y}$ ($0 \leqq x,y$, $x+y \leqq 1$).

The inner layer comprises one or more layers of Ti (CwBxNyOz) (herein, $w+x+y+z=1$, $w,x,y,z \geqq 0$) which is high in hardness and abrasion resistance, by which high wear resistance can be obtained. Particularly, in a case where titanium carbonitride having a film thickness of 2–20 μm and a columnar crystal structure is disposed in the inner layer, wear resistance and chipping resistance can be simultaneously realized, and damage from the aluminum oxide of the outer layer can be prevented in intermittent cutting or cutting for machining parts. In addition, high wear resistance can be obtained while preventing destruction of the film of the inner layer, by which tool performance can be significantly improved. If the film thickness of titanium carbonitride is less than 2 μm, wear resistance is insufficient, and if the thickness exceeds 20 μm, the strength of the coating layer decreases.

Furthermore, when an innermost layer contacting with the substrate comprises a titanium nitride film of 0.2–3 μm in thickness having a granular structure, tool performance can be further improved by improving the adhesive force between the inner layer and the substrate. If this film thickness is less than 0.2 μm, the effect for improving adhesive force of the film is insufficient, and if the thickness exceeds 3 μm, wear resistance lowers.

The abovementioned effects increase if the smooth surfaces comprises substantially aluminum oxide. This is because aluminum oxide is chemically stable in comparison with Ti (CwBxNyOz), and is low in properties of welding and adhesion to a workpiece and high in resistance against oxidative wear and diffusion wear. Furthermore, the effects of the alloy according to the invention increase when the aluminum oxide layer has an alpha crystal structure. Alpha aluminum oxide has a high-temperature stable type crystal structure, and is high in strength and heat resistance and effective as a coating film at the outermost layer directly contacted by a workpiece. The film thickness of aluminum oxide is preferably 0.5 through 15 μm. If the film thickness is less than 0.5 μm, the effect of aluminum oxide cannot be obtained, and if the film thickness exceeds 15 μm, the strength of the coating layer decreases.

Aluminum oxide is generally black or brown, so that if aluminum oxide is applied to the whole surface of the outermost layer of the coating layer, it becomes difficult to distinguish used corners at the cutting site. In order to solve such a problem, it is preferable that the range in which aluminum oxide is exposed is limited so that aluminum oxide is locally set to be an outermost layer. That is, it is effective to apply TiN and ZrN in gold or TiCN and ZrCN in pink or orange on aluminum oxide as distinctive layers. The ranges for forming an aluminum oxide layer to be an outermost layer are desirably a range of 2000 μm or less from the rake face side boundary of the blade-edge ridge toward the rake face side, and a range of 400 μm or less from the flank side boundary of the blade-edge ridge toward the flank side. If they exceed these ranges, it becomes difficult to distinguish used corners. It is preferable that distinctive layers are provided at portions other than these ranges.

Grinding by using a buff, brush, barrel, elastic grindstone or the lithe is preferable as a method for controlling the surface roughness of the surface of the hard coating layer to achieve a predetermined surface roughness. In addition, surface reforming by means of microblasting and ion-beam radiation may also be applied.

As for the method for forming a hard coating layer, physical vapor deposition (PVD) and chemical vapor deposition (CVD), which are generally known, can be used. Likewise, generally known deposition conditions of temperature and pressure can be employed.

BEST MODE FOR CARRYING OUT THE INVENTION

Figure 1:
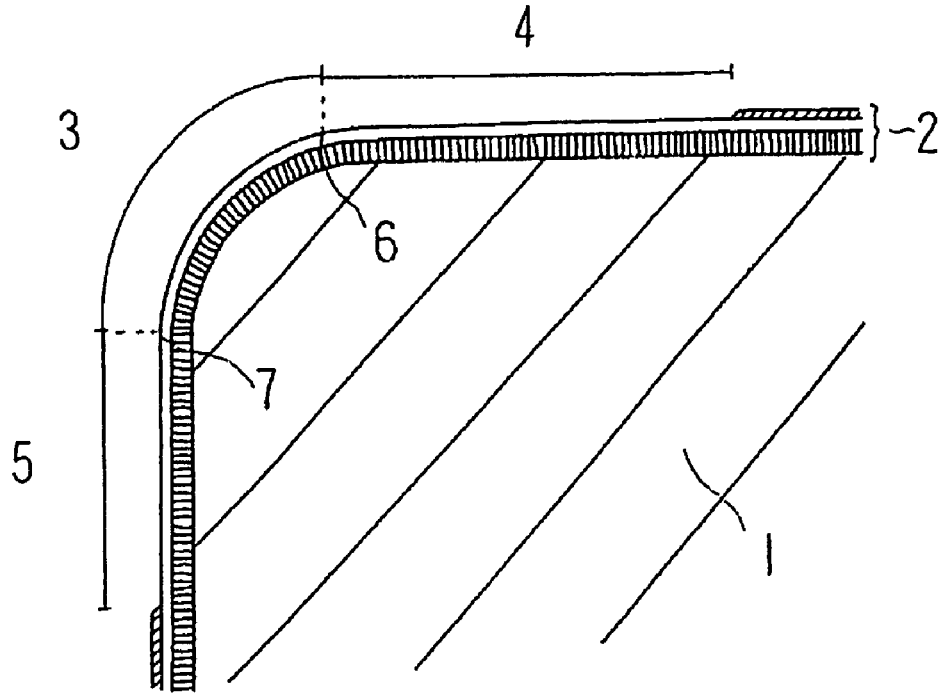
FIG. 1 is a partial sectional view of a tool of the invention to which round honing is applied.

Hereinafter, an embodiment of the invention is explained.

A tool according to the invention is explained in detail with reference to FIG. 1 and FIG. 2. Both figures are sectional views showing the vicinity of the blade-edge ridge of the tool. Hard coating layer 2 is formed on substrate 1 comprising a hard sintered alloy or cermet.

The face extending horizontally from a blade-edge ridge 3 is smooth surface 4 at the rake face side, and the face extending vertically from the blade-edge ridge 3 is smooth surface 5 at the flank side. In the tool of the present invention, the surface roughness of the hard coating layer 2 is controlled in the ranges of the blade-edge ridge 3, smooth surface 4 at the rake face side, and smooth surface 5 at the flank side. The boundary between the blade-edge ridge 3 and the smooth surface 4 of the rake face side is rake face side boundary 6 of the blade-edge ridge, and the boundary between the blade-edge ridge 3 and the smooth surface 5 of the flank side is flank side boundary 7 of the blade-edge ridge.

The blade-edge ridge 3 includes an edge-honing portion for preventing blade-edge chipping. Round-honing (FIG. 1) and chamfer-honing (FIG. 2) may be employed as edge-honing.

Figure 2:
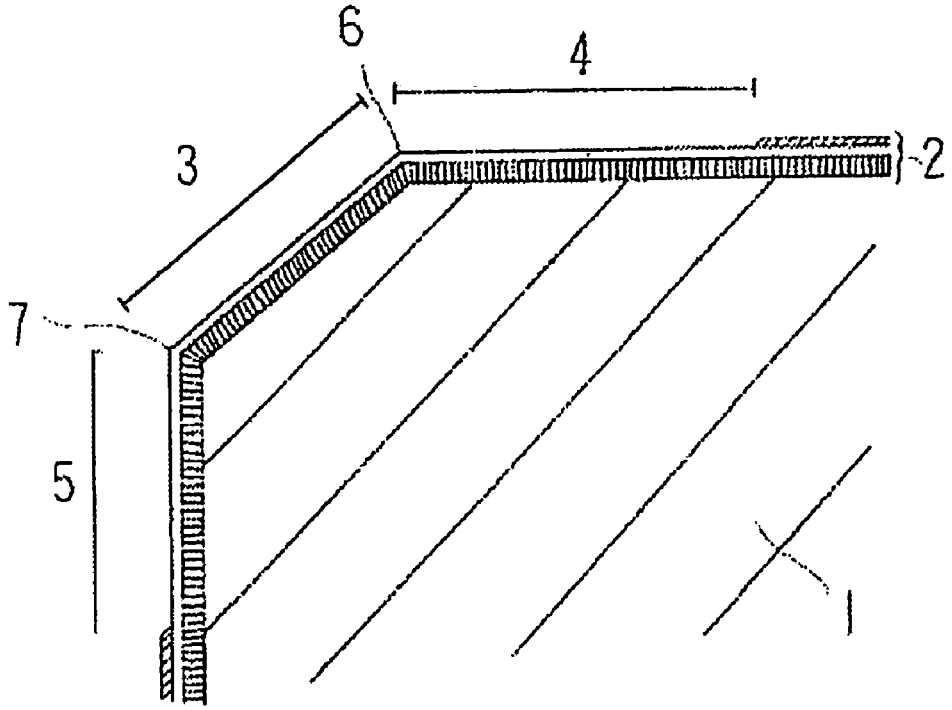
FIG. 2 is a partial sectional view of the tool of the invention to which chamfer-honing is applied.

In FIG. 1 and FIG. 2, the hard coating layer includes a two-layered portion and a three-layered portion, and for example, the two-layered portion is constructed so as to have an outer layer formed from aluminum oxide, and the three-layered portion is constructed so as to have an outer layer formed from TiN as a distinctive layer. The two-layered portion is formed by partially eliminating the third layer by means of grinding.

EXPERIMENTAL EXAMPLE 1

Cutting tips with a form of model No. SNMG120408 were manufactured from a sintered hard alloy with a composition of 87% WC-2% TiCN-3% TaNbC-8% Co (%: % by weight). Next, the whole of the cutting blade portion was subjected to honing at a width of 0.05 mm viewed from the rake face side as edge machining to form a substrate. The flank of this substrate has an as-sintered surface.

This substrate surface was coated with TiN (0.5 μm), TiCN (10 μm), $\alpha$-$Al_2O_3$ (3 μm), and TiN (1.0 μm) by means of normal CVD. Next, at the blade-edge ridge and the rake face side and flank side from the same ridge, grinding and lapping were applied by using artificial brushes with four hardnesses, and then surface roughness (Rmax) with respect to the reference length of 5 μm was measured from a scanning electron microscope photograph of the cross-section of the tips. The results of the measurement are shown in Table I.

TiN (1.0 μm) is at the outermost layer in the above-mentioned film structure. However, since grinding was applied at the blade-edge ridge and the rake face side and flank side from the same ridge, another layer can be exposed as an outermost layer in some tip samples. According to the invention, the whole TiCN is made of columnar crystals, and the whole TiN is made of granular crystals. These are found to be similar in other experimental examples described later.

By using the cutting tip samples thus manufactured, the wear resistance and the surface roughness of machined workpieces were evaluated under the following conditions. The results of evaluation are also shown in Table I.

(Cutting Conditions)

Workpiece: SCM415

Cutting rate: 200 m/min

Depth of cut: 0.5 mm

Feed: 0.25 mm/rev

Cutting period: 30 min

Cutting oil: dry cutting

TABLE I

| | | Outermost layer quality/surface roughness (Rmax) | | | | | |
|---|---|---|---|---|---|---|---|
| | | | | | Range between 100 μm and | Cutting performance | |
| | Sample No. | Blade-edge ridge and range of 200 μm from the boundary $R_R$ (μm) | Range between 200 μm and 500 μm from the boundary $R_R$ (μm) | Range up to 50 μm from the boundary $R_F$ toward flank side (μm) | 200 μm from the boundary $R_F$ toward the flank side(μm) | Roughness of machined surface (Rmax) μm | Flank wear (mm) |
| Present invention | 1-1 | $Al_2O_3$/0.15 | $Al_2O_3$/0.15 | $Al_2O_3$/0.18 | $Al_2O_3$/0.18 | 2.5 | 0.10 |
| | 1-2 | $Al_2O_3$/0.19 | TiN/0.25 | $Al_2O_3$/0.18 | TiN/0.26 | 6.5 | 0.18 |
| | 1-3 | TiN/0.18 | TiN/0.19 | TiN/0.16 | TiN/0.18 | 5.5 | 0.20 |
| | 1-4 | TiN/0.18 | TiN/0.26 | TiN/0.18 | TiN/0.3 | 7.0 | 0.22 |
| Comparative item | 1-5 | $Al_2O_3$/0.25 | TiN/0.38 | $Al_2O_3$/0.25 | TiN/1.33 | 12.0 | 0.45 |
| | 1-6 | $Al_2O_3$/0.18 | TiN/0.25 | TiN/0.35 | ← | 12.5 | 0.40 |
| | 1-7 | TiN/1.4 | ← | TiN/0.25 | ← | 12.8 | Chipping |
| | 1-8 | TiN/1.3 | ← | TiN/1.2 | ← | 13.8 | Chipping |

* Herein, $R_R$: Rake face side boundary of the blade-edge ridge
$R_F$: Flank side boundary of the blade-edge ridge As shown in Table I, it is understood that the wear resistance and the surface roughness of the machined are significantly improved when the hard coating layer at the blade-edge ridge, a range of 200 μm from the rake face side boundary of the same ridge toward the rake face side, and a range of 50 μm from the flank side boundary of the same ridge toward the flank side is set to be Rmax≦0.2 μm with respect to the reference length. Particularly, the larger the smooth surface of the hard coating layer, the greater the effect. It can be understood that aluminum oxide is more preferably used for the outermost layer of the hard coating layer.

EXPERIMENTAL EXAMPLE 2

Cutting tips with a form of model No. CNMG120408 were manufactured from a sintered hard alloy with a composition of 88% WC-3% ZrCN-4% TaNbC-5% Co (%: % by weight). Next, for edge machining to prepare substrates, the whole of the cutting blade portion was subjected to honing in a width of 0.05 mm viewed from the rake face side. The flank of this substrate is a sintered surface.

Cutting tip samples were manufactured by coating the surface of these substrates with TiN, TiC, TiCN, ZrCN, $Al_2O_3$, and others by means of normal chemical vapor deposition (CVD). Next, the blade-edge ridge and the rake face side and flank side from the same ridge were subjected to grinding and lapping by using an elastic grindstone, and then the surface roughness (Rmax) with respect to a refer ence length of 5 μm was measured from a scanning electron microscope photograph of the cross-section of the tips. The results of the measurement are shown in Table II.

By using the cutting tip samples thus manufactured, cutting was carried out under the following conditions and the wear resistance and the surface roughness of the machined workpieces were evaluated. The results of evaluation are also shown in Table II.

(Cutting Conditions)
Workpiece: FCD700
Cutting rate: 200 m/min
Depth of cut: 0.5 mm
Feed: 0.2 mm/rev
Cutting period: 20 min
Cutting oil: Water-soluble of 81% WC-5% TiCN-4% TaNbC-10% Co (%: % by weight). Next, for edge machining to prepare substrates, the whole of the cutting blade portion was subjected to chamfer-honing in a width of 0.10 mm viewed from the rake face side. The surface of the substrates partially includes an as-sintered surface and a ground surface.

Cutting tip samples were manufactured by coating the surface of the substrates with TiN, TiC, TiCN, TiAlN, $Al_2O_3$, and others by normal chemical vapor deposition (CVD) and physical vapor deposition (PVD)(herein, arc ion plating). Next, at the blade-edge ridge, rake face side and flank side, grinding and lapping were applied by using a brush, and then

TABLE II

| | Sample No. | Structure of the hard coating layer (μm) (in order from the base metal) | Crystal condition of $Al_2O_3$ | Outermost layer quality/Surface roughness (Rmax): Blade-edge ridge and range of 200 μm from the boundary $R_R$ (μm) | Outermost layer quality/Surface roughness (Rmax): Range up to 50 μm from the boundary $R_F$ toward the flank side (μm) | Cutting performance: Roughness of machined surface (Rmax) μm | Cutting performance: Flank wear (mm) |
|---|---|---|---|---|---|---|---|
| Present invention | 2-1 | TiN (0.5) TiCN (10) $Al_2O_3$ (3.0) TiN (0.5) | α | $Al_2O_3$/0.19 | $Al_2O_3$/0.19 | 3.6 | 0.12 |
| | 2-2 | TiN (0.5) TiCN (10) TiCBNO (0.5) $Al_2O_3$(3.0) TiN (0.5) | κ | $Al_2O_3$/0.18 | $Al_2O_3$/0.19 | 4.8 | 0.15 |
| | 2-3 | TiN (0.5) TiCN (10) TiBNO (1.0) $Al_2O_3$(3.0) TiCN (0.5) | α | $Al_2O_3$/0.15 | TiCN/0.19 | 6.5 | 0.19 |
| | 2-4 | TiN (0.5) TiCN (3.5) TiC (0.5) $Al_2O_3$(12.0) ZrCN (0.5) | α | $Al_2O_3$/0.19 | ZrCN/0.19 | 7.0 | 0.18 |
| | 2-5 | TiN (0.5) TiCN (7.0) TiCO (0.5) $Al_2O_3$(8.0) TiN (0.5) | κ | $Al_2O_3$/0.16 | TiN/0.19 | 7.8 | 0.23 |
| Comparative item | 2-6 | TiN (0.1) TiCN (7.0) $Al_2O_3$ (3.0) TiN (0.5) | α | $Al_2O_3$/1.8 | $Al_2O_3$/0.19 | 15.4 | Film spalling |
| Present invention | 2-7 | TiN (3.2) TiCN (7.5) $Al_2O_3$ (3.0) TiN (0.5) | κ | $Al_2O_3$/0.19 | $Al_2O_3$/0.19 | 8.3 | 0.29 |
| | 2-8 | TiN (0.5) TiCN (25) $Al_2O_3$ (3.0) TiN (0.5) | α | $Al_2O_3$/0.19 | $Al_2O_3$/0.19 | 8.9 | Slight chipping |
| | 2-9 | TiN (0.5) TiCN (10) $Al_2O_3$ (0.3) TiN (0.5) | α | $Al_2O_3$/0.19 | $Al_2O_3$/0.19 | 8.0 | 0.30 |
| | 2-10 | TiN (0.5) TiCN (10) $Al_2O_3$ (18.0) TiN (0.5) | κ | $Al_2O_3$/0.19 | $Al_2O_3$/0.19 | 8.6 | slight chipping |

* Herein, $R_R$: Rake face side boundary of the blade-edge ridge
$R_F$: Flank side boundary of the blade-edge ridge Analyzing Table II, when the base TiN layer is less than 0.2 μm in thickness (No. 2–6), the film adhesive force decreases and film spalling occurs, and when the layer is more than 3 μm in thickness (No. 2–7), wear resistance slightly decreases. In the former case, it is understood that the surface roughness of the machined workpiece deteriorates When the TiCN layer is more than 20 μm in thickness (No. 2–8) or when the $Al_2O_3$ layer is more than 15 μm in thickness (No. 2–10), micro-chipping occurs, and the surface roughness of the machined workpiece deteriorates slightly. On the other hand, it is understood that wear resistance decreases slightly when the thickness of the $Al_2O_3$ layer is less than 0.5 μm (No. 2–9).

EXPERIMENTAL EXAMPLE 3

Cutting tips with a form of model No. SDKN1203 were manufactured from a sintered hard alloy with a composition the surface roughness (Rmax) with respect to the reference length of 5 μm was measured from a scanning electron microscope photograph of the cross-section of the tips. The results of the measurement are shown in Table III.

By using the cutting tip samples thus manufactured, milling was carried out under the following conditions, and then the wear resistance and the surface roughness of the machined workpieces were evaluated. The results of evaluation are also shown in Table III.

(Cutting Conditions)
Cutter: FPG4160R
Workpiece: SCM435
Cutting rate: 250 m/min
Depth of cut: 0.8 mm
Feed: 0.25 mm/blade
Cutting period: 30 min

TABLE III

| | Sample No. | Structure of the hard coating layer (μm) (in order from the base metal) | Coating method | Outermost layer quality/Surface roughness (Rmax) Blade-edge ridge and range of 200 μm from the boundary $R_R$ (μm) | Range up to 50 μm from the boundary $R_F$ toward the flank side (μm) | Cutting performance Roughness of machined surface (Rmax) μm | Flank wear (mm) |
|---|---|---|---|---|---|---|---|
| Present invention | 3-1 | TiN (0.5) TiCN (5) $Al_2O_3$ (5.0) TiN (0.5) | CVD | $Al_2O_3$/0.19 | $Al_2O_3$/0.16 | 4.5 | 0.12 |
| | 3-2 | TiN (0.5) TiCN (3) TiCBNO (0.2) $Al_2O_3$ (1.0) TiN (0.5) | CVD | TiCN/0.18 | TiCN/0.19 | 5.2 | 0.15 |
| | 3-3 | TiN (0.5) TiAlN (3.0) TiN (0.5) | PVD | TiAlN/0.18 | TiAlN/0.15 | 7.0 | 0.19 |
| | 3-4 | TiN (0.5) $Al_2O_3$ (3.5) TiCN (0.5) | PVD | TiCN/0.13 | TiCN/0.15 | 7.5 | 0.18 |
| | 3-5 | TiN (0.5) TiCN (3.5) TiN (0.5) | PVD | TiCN/0.18 | TiN/0.19 | 7.2 | 0.23 |
| Comparative item | 3-6 | TiN (0.1) TiCN (5.0) $Al_2O_3$ (5.0) TiN (0.5) | CVD | $Al_2O_3$/1.8 | $Al_2O_3$/2.5 | 12.5 | Film spalling |
| | 3-7 | TiN (0.1) TiCN (5.0) $Al_2O_3$ (5.0) TiN (0.5) | CVD | $Al_2O_3$/0.19 | $Al_2O_3$/2.8 | 13.5 | 0.55 |
| | 3-8 | TiN (0.1) TiCN (5.0) $Al_2O_3$ (5.0) TiN (0.5) | CVD | $Al_2O_3$/2.6 | $Al_2O_3$/0.17 | 14.0 | Chipping |
| | 3-9 | TiN (0.5) TiAlN (3.0) TiN (0.5) | PVD | TiN/1.0 | TiN/1.3 | 11.5 | 0.40 |
| | 3-10 | TiN (0.5) TiAlN (3.5) TiCN (0.5) | PVD | TiCN/1.2 | TiCN/1.2 | 13.5 | 0.55 |

* Herein, $R_R$: Rake face side boundary of the blade-edge ridge
$R_F$; Flank side boundary of the blade-edge ridge From Table III, it is understood that the cutting tool of the invention is excellent in wear resistance and machined surface quality even in the case of steel milling.

EXPERIMENTAL EXAMPLE 4

Cutting tips with a form of model No. CNMG120408 were manufactured from a cermet alloy with a composition of 12% WC-65% TiCN-6% TaNbC-3% MO2C-7% Co-7% Ni (%: % by weight). Then, for edge machining to prepare substrates, the whole of the cutting blade portion was subjected to honing in a width of 0.06 mm viewed from the rake face side. The flank of the substrates has an as-sintered surface.

Cutting tip samples were manufactured by coating the surface of the substrates with TiN, TiC, TiCN, TiAlN, $Al_2O_3$, and others by normal chemical vapor deposition (CVD) and physical vapor deposition (PVD)(herein, arc ion plating). Next, at the blade-edge ridge, rake face side, and flank side, grinding and lapping were applied by using an elastic grindstone, and then surface roughness (Rmax) with respect to the reference length of 5 μm was measured from a scanning electron microscope photograph of the cross-section of the tips. The results of the measurement are shown in Table IV.

By using the cutting tip samples thus manufactured, cutting was carried out under the following conditions, and the wear resistance and the surface roughness of the machined workpieces were evaluated. The results of the evaluation are also shown in Table IV.

(Cutting Conditions)
Workpiece: SCM415
Cutting rate: 300 m/min
Depth of cut: 0.5 mm
Feed: 0.25 mm/rev
Cutting period: 15 min
Cutting oil: dry cutting

TABLE IV

| | Sample No. | Structure of the hard coating layer (μm) (in order from the base metal) | Coating method | Outermost layer quality/Surface roughness (Rmax) Blade-edge ridge and range of 200 μm from the boundary $R_R$ (μm) | Range up to 50 μm from the boundary $R_F$ toward the flank side (μm) | Cutting performance Roughness of machined surface (Rmax) μm | Flank wear (mm) |
|---|---|---|---|---|---|---|---|
| Present invention | 4-1 | TiN (0.5) TiCN (3) $Al_2O_3$ (5.0) TiN (0.5) | CVD | $Al_2O_3$/0.15 | $Al_2O_3$/0.16 | 3.0 | 0.10 |
| | 4-2 | TiN (0.5) $Al_2O_3$ (1.5) TiN (0.5) | CVD | $Al_2O_3$/0.18 | $Al_2O_3$/0.18 | 5.5 | 0.11 |
| | 4-3 | TiN (0.5) TiAlN (3.0) TiN (0.5) | PVD | TiAlN/0.13 | TiAlN/0.13 | 6.8 | 0.17 |
| | 4-4 | TiN (0.5) TiCN (3.5) TiN (0.5) | PVD | TiCN/0.18 | TiCN/0.19 | 7.5 | 0.22 |

TABLE IV-continued

| | Sample No. | Structure of the hard coating layer (μm) (in order from the base metal) | Coating method | Outermost layer quality/Surface roughness (Rmax) Blade-edge ridge and range of 200 μm from the boundary $R_R$ (μm) | Range up to 50 μm from the boundary $R_F$ toward the flank side (μm) | Cutting performance Roughness of machined surface (Rmax) μm | Flank wear (mm) |
|---|---|---|---|---|---|---|---|
| Comparative item | 4-5 | TiN (0.5) TiCN (3) $Al_2O_3$ (5.0) TiN (0.5) | CVD | $Al_2O_3$/2.0 | $Al_2O_3$/2.2 | 12.5 | Chipping |
| | 4-6 | TiN (0.5) $Al_2O_3$ (1.5) TiN (0.5) | CVD | $Al_2O_3$/0.19 | $Al_2O_3$/1.5 | 12.0 | Chipping |
| | 4-7 | TiN (0.5) TiAlN (3.0) TiN (0.5) | PVD | TiAlN/1.2 | TiAlN/1.2 | 14.5 | 0.55 |
| | 4-8 | TiN (0.5) TiCN (3.5) TiN (0.5) | PVD | TiCN/0.2 | TiCN/1.2 | 11.5 | 0.75 |

* Herein, $R_R$: Rake face side boundary of the blade-edge ridge
$R_F$: Flank side boundary of the blade-edge ridge As can be seen in Table IV, the cutting tool of the invention using cermet for the substrate is also excellent in wear resistance and machined surface quality in the case of finish machining for steel.

INDUSTRIAL APPLICABILITY

As described above, with the coated cutting tool of the invention, adherence of a workpiece due to welding hardly occurs when cutting, hence fracture resistance and wear resistance simultaneously can be achieved, and the tool life can be improved. Particularly, these effects are remarkable in the case of dry cutting. Furthermore, excellent surface quality of a machined workpiece also achieved, and this is suitable for high-accurate machining.

What is claimed is:

1. A coated cutting tool with a hard coating layer formed on a substrate, wherein the substrate comprises a binder phase comprising one or more kinds of iron-group metals and a hard phase comprising one or more substances selected from carbides, nitrides, and oxides of elements of Groups IVa, Va and VIa of the Periodic Table and solid solutions thereof, and the coating layer comprises a smooth face having a surface roughness (Rmax) of 0.2 μm or less (the reference length being 5 μm) substantially at a blade-edge ridge and in a region which extends at least 200 μm from a rake face side boundary of the ridge toward a rake face side, and extends at least 50 μm from a flank side boundary of the ridge toward a flank side.

2. The cutting tool of claim 1, wherein the flank of the substrate has an as-sintered surface.

3. The cutting tool of claim 1, wherein the hard coating layer comprises one or more kinds of substances selected from carbides, nitrides, carbonitrides, borides, and oxides of one or more metals of Groups IVa, Va and VIa of the Periodic Table, Al and Si, and solid solutions thereof.

4. The cutting tool of claim 3, wherein the hard coating layer comprises an inner layer comprising at least one or more layers of $TiC_wB_xN_yO_z$ wherein w+x+y+z=1 and w, x, y, z≧0, a middle layer comprising an aluminum oxide layer, and an outer layer comprising $TiC_xN_yO_{1-x-y}$ or $ZrC_xN_yO_{1-x-y}$ (0≦x, y, and x+y≦1).

5. The cutting tool of claim 1, wherein the smooth face comprises an aluminum oxide layer.

6. The cutting tool of claim 5, wherein the aluminum oxide layer comprises alpha aluminum oxide having a film thickness of 0.5 to 15 μm.

7. The cutting tool of claim 1, wherein the smooth face has a surface roughness of 0.2 μm in a region which extends at least 500 μm from the rake face side boundary of the ridge toward the rake face side, and extends at least 200 μm from the flank side boundary of the ridge toward the flank side.

8. The cutting tool of claim 4, wherein the inner layer comprises titanium carbonitride having a film thickness of 2 to 20 μm and a columnar crystal structure.

9. The cutting tool of claim 1, wherein the hard coating layer comprises at least two layers, and a layer which contacts the substrate comprises titanium nitride having a film thickness of 0.2 to 3 μm and a granular structure.

10. The cutting tool of claim 1, wherein the substrate comprises cermet.

11. A coated cutting tool with a hard coating layer formed on a substrate, wherein the substrate comprises a binder phase comprising one or more kinds of iron-group metals and a hard phase comprising one or more substances selected from carbides, nitrides, and oxides of elements of Groups IVa, Va and VIa of the Periodic Table and solid solutions thereof, and the hard coating layer comprises one or more kinds of substances selected from carbides, nitrides, carbonitrides, borides, and oxides of one or more metals of Groups IVa, Va and VIa of the Periodic Table, Al and Si, and solid solutions thereof and has a smooth face having a surface roughness (Rmax) of 0.2 μm or less (the reference length being 5 μm) substantially at a blade-edge ridge and in a region which extends at least 500 μm from a rake face side boundary of the ridge toward a rake face side, and extends at least 200 μm from a flank side boundary of the ridge toward a flank side.

12. The cutting tool of claim 11, wherein the flank of the substrate has an as-sintered surface.

13. The cutting tool of claim 11, wherein the hard coating layer comprises an inner layer comprising at least one or more layers of $TiC_wB_xN_yO_z$ wherein w+x+y+z=1 and w, x, y, z≧0, a middle layer comprising an aluminum oxide layer, and an outer layer comprising $TiC_xN_yO_{1-x-y}$ or $ZrC_xN_yO_{1-x-y}$ (0≦x, y, and x+y≦1).

14. The cutting tool of claim 13, wherein the smooth face comprises an aluminum oxide layer.

15. The cutting tool of claim 14, wherein the inner layer comprises titanium carbonitride having a film thickness of 2 to 20 μm and a columnar crystal structure.

16. The cutting tool of claim 14, wherein the aluminum oxide layer comprises alpha aluminum oxide having a film thickness of 0.5 to 15 μm.

17. The cutting tool of claim 11, wherein the hard coating layer comprises at least two layers, and a layer which contacts the substrate comprises titanium nitride having a film thickness of 0.2 to 3 μm and a granular structure.

18. The cutting tool of claim 11, wherein the substrate comprises cermet.

19. A coated cutting tool with a hard coating layer formed on a substrate, wherein the substrate comprises a binder phase comprising one or more kinds of iron-group metals and a hard phase comprising one or more substances selected from carbides, nitrides, and oxides of elements of Groups IVa, Va and VIa of the Periodic Table and solid solutions thereof, and the hard coating layer comprises one or more kinds of substances selected from carbides, nitrides, carbonitrides, borides, and oxides of one or more metals of Groups IVa, Va and VIa of the Periodic Table, Al and Si, and solid solutions thereof and has a smooth face comprising an aluminum oxide layer and having a surface roughness (Rmax) of 0.2 μm or less (the reference length being 5 μm) substantially at a blade-edge ridge and in a region which extends at least 200 μm from a rake face side boundary of the ridge toward a rake face side, and extends at least 50 μm from a flank side boundary of the ridge toward a flank side.

20. The cutting tool of claim 19, wherein the aluminum oxide layer comprises alpha aluminum oxide having a film thickness of 0.5 to 15 μm.

* * * * *